US012642370B2

(12) United States Patent
Giloley

(10) Patent No.: US 12,642,370 B2
(45) Date of Patent: Jun. 2, 2026

(54) ADJUSTABLE MERCHANDISE HOOK ASSEMBLY

(71) Applicant: Harold Giloley, Wallingford, PA (US)

(72) Inventor: Harold Giloley, Wallingford, PA (US)

( * ) Notice: Subject to any disclaimer, the term of this patent is extended or adjusted under 35 U.S.C. 154(b) by 0 days.

(21) Appl. No.: 18/312,986

(22) Filed: May 5, 2023

(65) Prior Publication Data

US 2024/0122378 A1 Apr. 18, 2024

Related U.S. Application Data

(60) Provisional application No. 63/416,080, filed on Oct. 14, 2022.

(51) Int. Cl.
*A47F 5/08* (2006.01)

(52) U.S. Cl.
CPC ..... *A47F 5/083* (2013.01)

(58) Field of Classification Search
CPC ..... A47F 5/083; A47F 5/0006; A47F 5/01; A47F 5/0807; A47F 5/0815; F16B 45/00
USPC ..... 248/215, 302–304
See application file for complete search history.

(56) References Cited

U.S. PATENT DOCUMENTS 3,245,645 A * 4/1966 Dupler ..... A47G 25/0678 248/303
3,396,929 A * 8/1968 Brown ..... E06C 7/14 248/227.2
4,607,753 A * 8/1986 Radek ..... A47F 5/0846 52/36.5
4,678,151 A * 7/1987 Radek ..... A47F 5/0846 248/223.41
4,852,838 A * 8/1989 Field ..... A47F 5/083 248/222.51
5,695,079 A * 12/1997 Peay ..... A47F 5/0884 211/118
7,252,274 B1 * 8/2007 Brannen ..... A47J 45/02 248/339
7,484,701 B2 * 2/2009 Hsieh ..... G10G 5/00 211/85.6
7,946,549 B2 * 5/2011 Forrest ..... A47B 96/06 248/249
8,002,225 B1 * 8/2011 Malone ..... A47B 81/00 248/339
10,376,059 B1 * 8/2019 Ebersole ..... A47B 61/003
11,311,130 B1 * 4/2022 Ebersole ..... A47B 61/003
(Continued)

*Primary Examiner* — Christopher Garft
(74) *Attorney, Agent, or Firm* — Kim IP Law Group LLC

(57) ABSTRACT

An adjustable merchandise hook assembly is configured to be coupled to a grate having first and second bars disposed parallel to one another. The adjustable merchandise hook assembly includes a first plate including a hook for engaging the first bar of the grate and defining an elongated slot extending parallel to a longitudinal axis of the first plate. A second plate includes a hook for engaging the second bar of the grate and defining an elongated slot extending parallel to a longitudinal axis of the second plate. The adjustable merchandise hook assembly also includes a merchandise suspension hook coupled to the first plate and adapted to support merchandise thereon and a releasable fastener configured to be disposed through the elongated slots of the first plate and the second plate to releasably couple the first plate and the second plate in at least a first position and in a second position.

10 Claims, 5 Drawing Sheets

(56) References Cited

U.S. PATENT DOCUMENTS

2002/0190174 A1* 12/2002 Pizzirusso ..... A47G 29/083
248/304
2009/0152424 A1* 6/2009 Forrest ..... A47F 5/01
248/304

* cited by examiner

ADJUSTABLE MERCHANDISE HOOK ASSEMBLY

CROSS REFERENCE TO RELATED APPLICATIONS

The present application claims the benefit of U. S. Provisional Patent Application No. 63/416,080 filed Oct. 14, 2022 entitled "ADJUSTABLE MERCHANDISE HOOK ASSEMBLY," the entire disclosure of which is hereby incorporated herein by reference.

BACKGROUND OF THE INVENTION

The present invention relates generally to an adjustable hook assembly being movable between positions. In particular, the present invention relates to an adjustable merchandise hook movable between a first position and a second position.

Conventional merchandise hook assemblies include a hook mechanism for hanging merchandise having a hole in the merchandise or within the packaging. The typical merchandise hook assemblies have a standard non-changeable width. This allows for merchandise hooks to be spaced at regular intervals, regardless of the size of the merchandise to be hung. Further, the non-changeable width requires different hooks to be used based on the size of the grate of the display case the merchandise is to be displayed in. This could require a user to purchase various sizes of merchandise hooks for a single display case.

Thus, there is still a need for a single conventional merchandise hook assembly that can accommodate various sizes of grates and/or merchandise without a separate merchandise hook assembly. Such a need is satisfied by the adjustable merchandise hook assembly of the present invention.

BRIEF SUMMARY OF THE INVENTION

According to one example, an adjustable merchandise hook assembly is configured to be coupled to a grate having first and second bars disposed parallel to one another. The adjustable merchandise hook assembly includes a first plate including a hook for engaging the first bar of the grate and defining an elongated slot extending parallel to a longitudinal axis of the first plate. A second plate includes a hook for engaging the second bar of the grate and defining an elongated slot extending parallel to a longitudinal axis of the second plate. The adjustable merchandise hook assembly also includes a merchandise suspension hook coupled to the first plate and adapted to support merchandise thereon and a releasable fastener configured to be disposed through the elongated slots of the first plate and the second plate to releasably couple the first plate and the second plate in at least a first position where a distance between the hook of the first plate and the hook of the second plate is a first distance and in a second position where the distance between the hook of the first plate and the hook of the second plate is a second distance with the second distance being different than the first distance.

According to another example, an adjustable assembly is configured to be coupled to a grate having first and second bars disposed parallel to one another. The adjustable assembly includes a first plate including a hook for engaging the first bar of the grate and defining an elongated slot extending parallel to a longitudinal axis of the first plate. A second plate includes a hook for engaging the second bar of the grate and defining an elongated slot extending parallel to a longitudinal axis of the second plate. The adjustable merchandise hook assembly also includes a releasable fastener configured to be disposed through the elongated slots of the first plate and the second plate to releasably couple the first plate and the second plate in at least a first position where a distance between the hook of the first plate and the hook of the second plate is a first distance and in a second position where the distance between the hook of the first plate and the hook of the second plate is a second distance with the second distance being different than the first distance.

In some examples, the elongated slot of the second plate is configured to align with the elongated slot of the first plate.

In some examples, the elongated slot of the second plate is configured to overlie or underlie with the elongated slot of the first plate.

In some examples, the merchandise suspension hook is suspended from an underside of the first plate.

In some examples, the merchandise suspension hook includes first portion which is secured to the first plate, a second portion downwardly extending from the first portion, and a third portion projecting forwardly from the second portion and adapted to support merchandise thereon.

In some examples, the merchandise suspension hook is releasably secured to the first plate.

In some examples, the first plate further includes a tube configured to releasably secure the merchandise suspension hook therethrough.

In some examples, the first portion of the merchandise suspension hook is configured to be disposed through the tube.

In some examples, the first portion of the merchandise suspension hook has a threaded end adapted to threadably receive a nut to fasten the merchandise suspension hook to the first plate.

In some examples, the merchandise suspension hook is permanently secured to the first plate.

In some examples, the first distance is approximately 1.25-7.50 inches.

In some examples, the first distance is approximately 2.25-6.50 inches.

In some examples, the first distance is approximately 3.25-5.50 inches.

BRIEF DESCRIPTION OF THE SEVERAL VIEWS OF THE DRAWINGS

The foregoing summary, as well as the following detailed description of the exemplary embodiments of the invention, will be better understood when read in conjunction with the appended drawings. For the purpose of illustrating the invention, there are shown in the drawings embodiments, which are presently preferred. It should be understood, however, that the invention is not limited to the precise arrangements and instrumentalities shown.

In the drawings:

FIG. 4 is another bottom perspective view of the adjustable merchandise hook of FIG. 1.

DETAILED DESCRIPTION OF THE INVENTION

Figure 1:
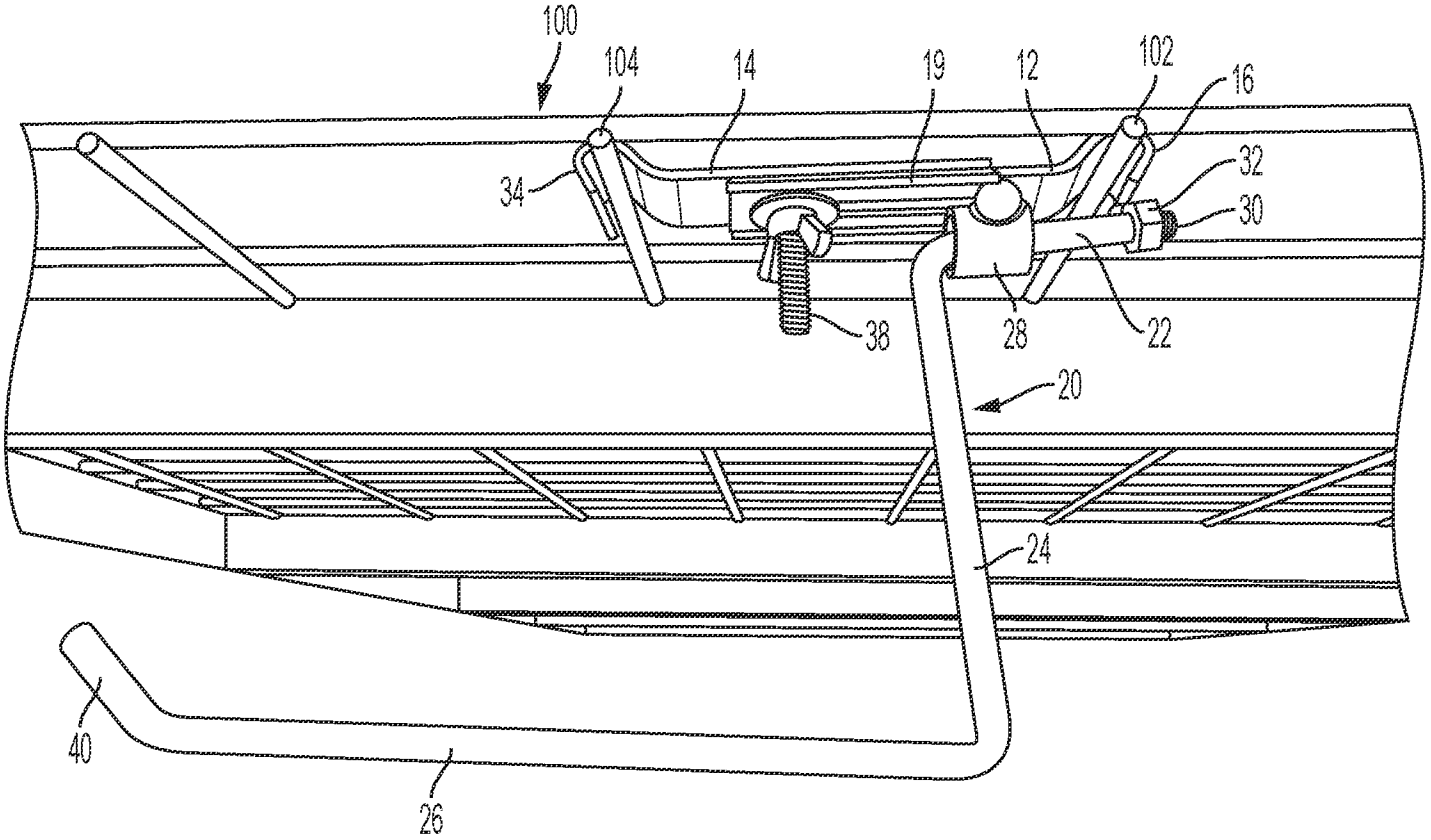
FIG. 1 is a side perspective view of an adjustable merchandise hook according to one example.
Figure 2:
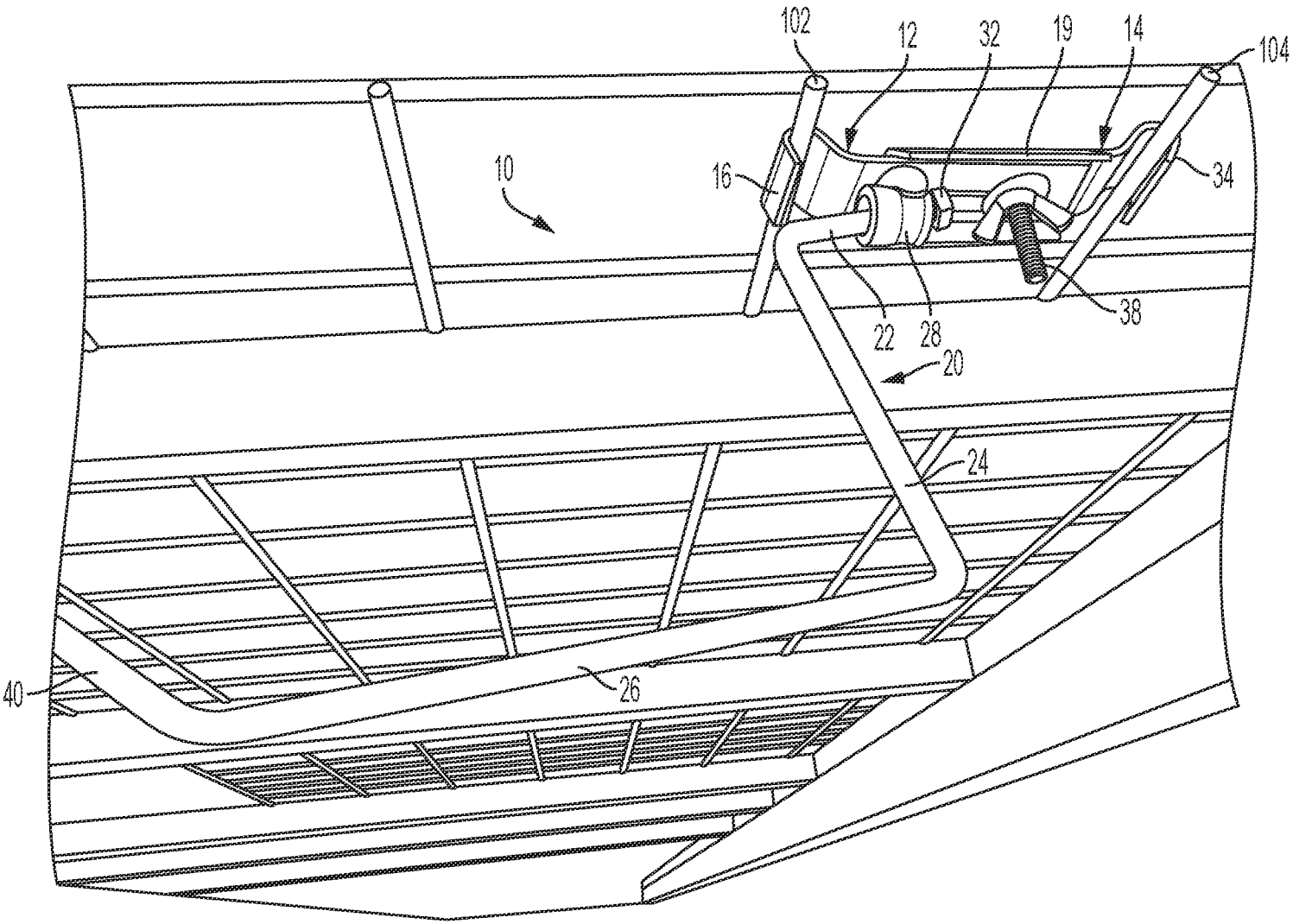
FIG. 2. a bottom perspective view of the adjustable merchandise hook of FIG. 1.

Reference will now be made in detail to the various embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout this disclosure, various aspects of the subject disclosure can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the present disclosure can be practiced without one or more of the specific features or advantages of a particular exemplary embodiment. In other instances, additional features and advantages may be recognized in certain embodiments that may not be present in all exemplary embodiments of the subject disclosure.

The subject disclosure relates, in general, to hook-type devices for displaying merchandise and, in particular, to an adjustable merchandise hook assembly 10. In accordance with the subject disclosure and as shown in attached FIGS. 1-4, the adjustable merchandise hook assembly 10 is adapted to be suspended from adjacent parallel bars of a grid-like grate 100. In some examples, the adjustable merchandise hook assembly 10 is configured to be coupled to the grate 100 and the grate 100 includes a first bar 102 and a second bar 104, which are disposed parallel to one another. The first bar 102 and the second bar 104 may be any distance apart and may extend any length, as desired to display the desired merchandise. In some examples, the first bar 102 and the second bar 104 are approximately, 1.25-7.50 inches apart. However, in some examples, the first bar 102 and the second bar 104 are approximately, 2.25-6.50 inches apart. In still other examples, the first bar 102 and the second bar 104 are approximately 3.25-5.50 inches apart. However, various other distances have been contemplated. In some examples, the grate 100 is comprised of a metal such as steel, however, the grate 100 may be comprised of any material without departing from the spirit of the invention.

Figure 3:
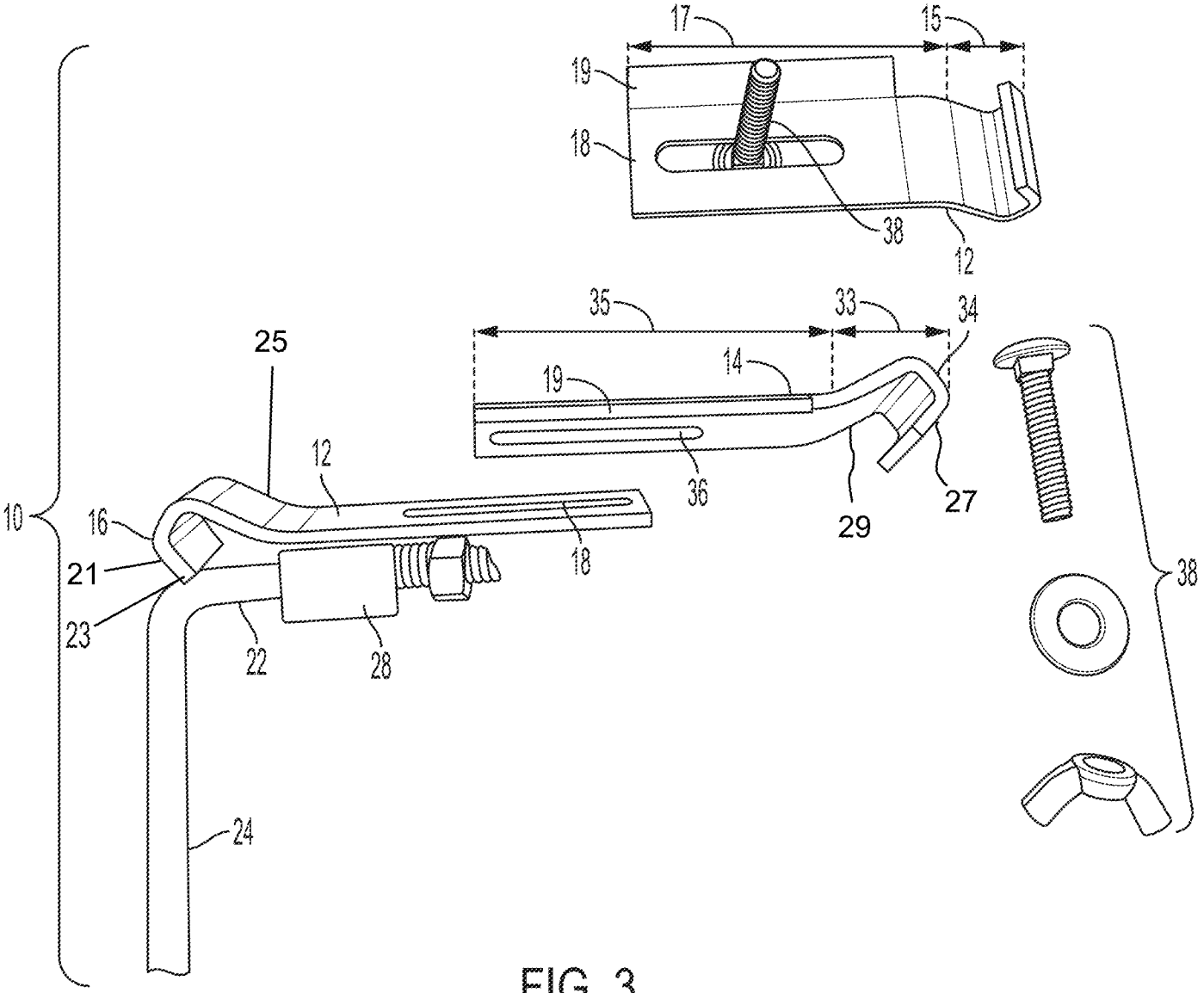
FIG. 3 is an exploded view of the adjustable merchandise hook of FIG. 1.
Figure 4:
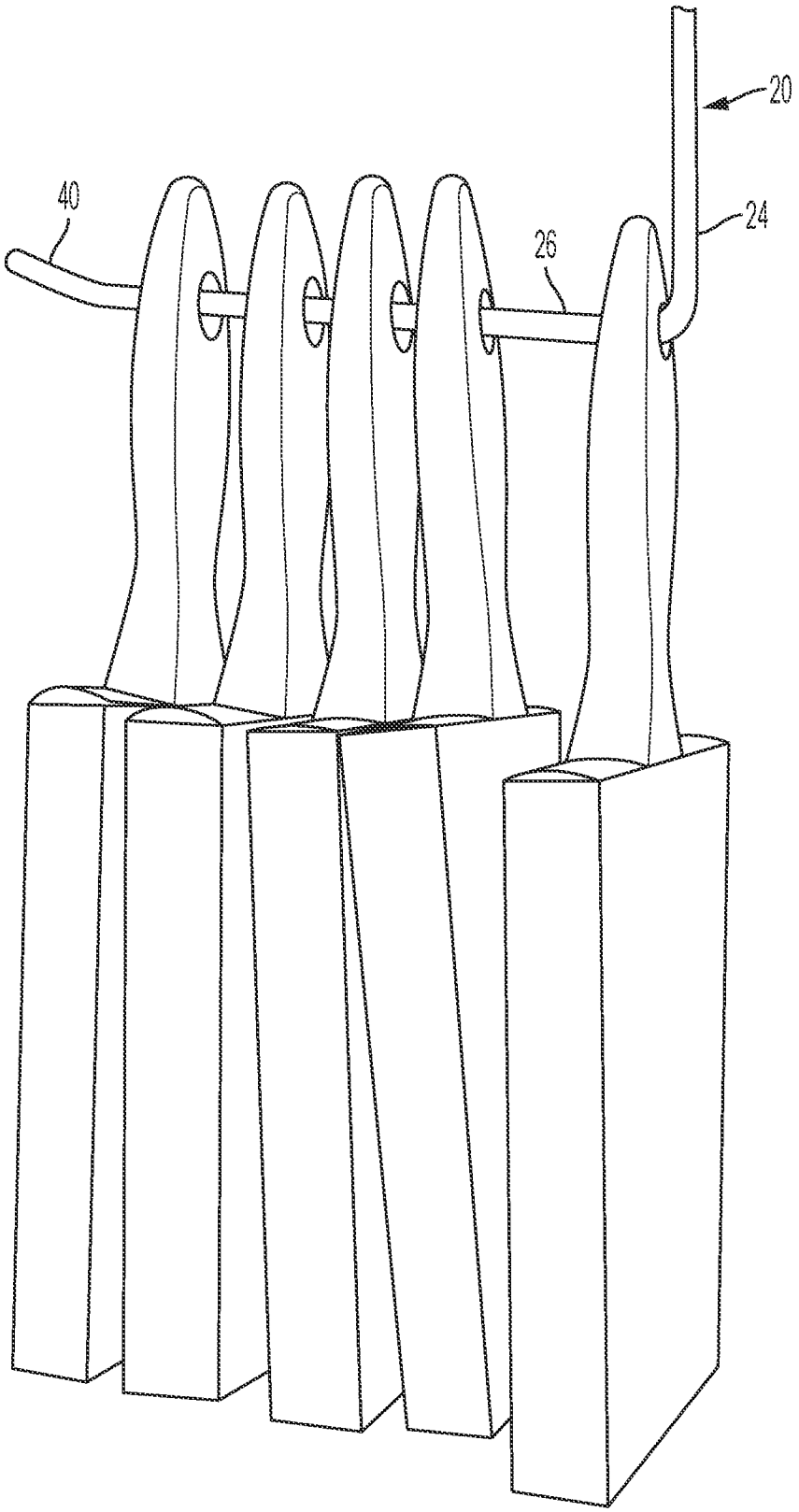
FIG. 4 is a side perspective view of the adjustable merchandise hook assembly of FIG. 1
Figure 5:
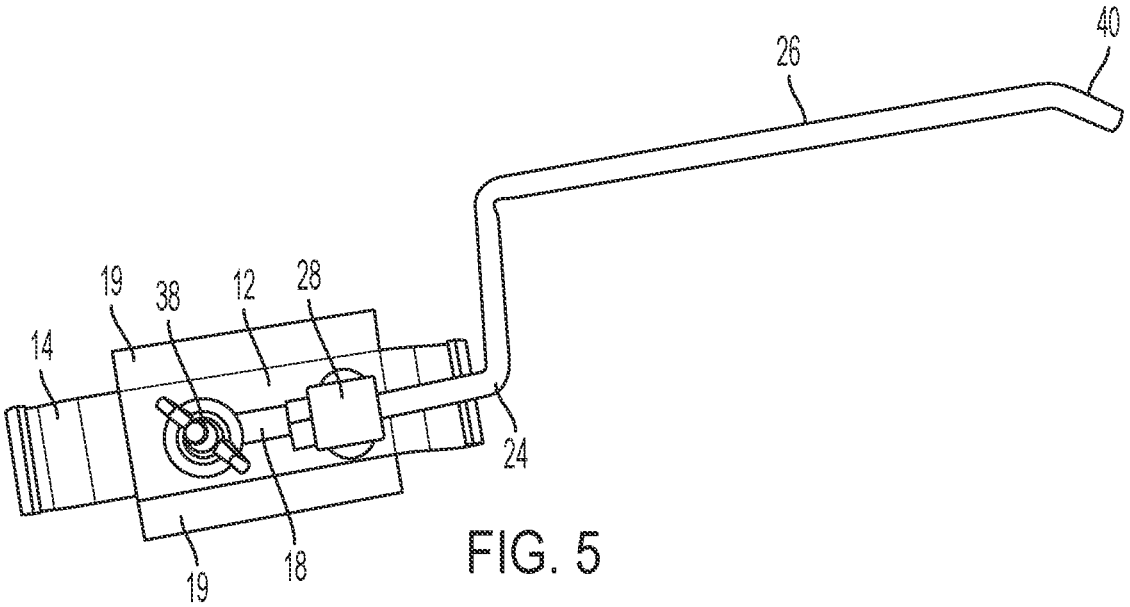

The merchandise hook assembly 10 includes a first plate 12 for engaging the first bar 102 of the grate 100 and a second plate 14 for engaging the adjacent second bar 104 of the grate 100 which extends parallel to the first bar 102. The first plate 12 includes a first portion 15 which includes a hook 16 for engaging the first bar 102 of the grate 100 and a second portion 17 which defines an elongated slot 18 therethrough. The hook 16 extends at an angle upward from the second portion 17 before curving back downwards towards the second portion 17. The angle of extension of the hook 16 may be approximately 40-60 degrees, as illustrated in FIG. 1, however, various other angles of extension have been contemplated. In the example shown, the curved portion of the hook 16 curves back downwards towards the second portion 17 of the first plate 12 at an angle of approximately 40-80-degree angle, however, various other angles of curvature have been contemplated. In some examples, the angle of extension and the angle of curvature of the hook 16 are configured to allow the first bar 102 to be coupled to the curvature of the hook 16. As such, the first portion 15 of the first plate 12 may include any angle of extension and/or angle of curvature as desired to allow the first bar 102 to fit within the hook 16. In some examples, the hook 16 has an open end 21 with a point end 23, and a bend end 25 substantially opposite the open end. As can be seen in FIG. 3, the bend end 25 extends beyond a plane defined by the first plate 12. Additionally, in the example shown, the hook 16 extends downward past a bottom surface of the second portion 17 of the first plate 12. However, various other configurations have been contemplated.

In some examples, the second portion 17 is a flat generally rectangular portion, however, it is contemplated that the second portion 17 may include a lip 19 or other feature to increase strength/and or fit in more narrow locations. The lip 19 may extend along the side of the second portion 17. In addition it is contemplated that the second portion 17 may be any shape and size as desired. In the example shown, the elongated slot 18 generally extends parallel to a longitudinal axis of the first plate 12. Moreover, in the example shown, the elongated slot 18 has the shape of an elongated oval, however, various other shapes of elongated slots have been contemplated including rectangular, triangular, and the like. In some examples, a thickness of the first portion 15 and the second portion 17 are the same, however, it is contemplated that one of the first portion 15 or the second portion 17 may have a larger or smaller thickness as desired.

The second plate 14 includes a first portion 33 which includes a hook 34 for engaging the second bar 102 of the grate 100 and a second portion 35 which defines an elongated slot 36 therethrough. The hook 34 extends at an angle upward from the second portion 35 before curving back downwards towards the second portion 35. The angle of extension of the hook 34 may be approximately 40-60 degrees, as illustrated in FIG. 1, however, various other angles of extension have been contemplated. In the example shown, the curved portion of the hook 34 curves back downwards towards the second portion 35 of the second plate 14 at an angle of approximately 40-80-degree angle, however, various other angles of curvature have been contemplated. In some examples, the angle of extension and the angle of curvature of the hook 34 are configured to allow the first bar 102 to be coupled to the curvature of the hook 34. As such, the first portion 33 of the second plate 14 may include any angle of extension and/or angle of curvature as desired to allow the second bar 104 to fit within the hook. In some examples, the hook 34 has an open end 27 and a bend end 29 substantially opposite the open end. As can be seen in FIG. 3, the bend end 29 extends beyond a plane defined by the second plate 14. Additionally, in the example shown, the hook 34 extends downward past a bottom surface of the second portion 35 of the second plate 14.

In some examples, such as the example shown in FIG. 3, the second portion 35 is a flat generally rectangular portion, however, it is contemplated that the second portion 35 may include a lip or other feature to increase strength/and or fit in more narrow locations, similar to the lip 19 of the second portion 17 of the first plate 12. The lip 19 may extend along the side of the second portion 35. In addition, it is contemplated that the second portion 35 and/or be any shape and size as desired. In the example shown, the elongated slot 36 generally extends parallel to a longitudinal axis of the second plate 14. Moreover, in the example shown, the elongated slot 36 has the shape of an elongated oval, however, various other shapes of elongated slots have been contemplated including rectangular, triangular, and the like. In some examples, a thickness of the first portion 33 and the second portion 35 are the same, however, it is contemplated that one of the first portion 33 or the second portion 35 may have a larger or smaller thickness as desired.

In some examples, the elongated slot 36 of the second plate 14 is configured to align with and overlie or underlie the elongated slot 18 of the first plate 12. In the example shown, the second portions 17, 35 of the first and second plate 14 overlap one another while the first portions 15, 33 of the first and second plate 14 are disposed opposite one another such that the first portion 15 of the first plate 12 is configured to engage the first bar 102 and the first portion 33 of the second plate 14 is configured to engage the second bar 104 and the second portions 17, 35 of the first and second plate 14 extend and overlap therebetween. In the example shown, the second plate 14 is disposed on top of the first plate 12, however, it is contemplated that the first plate 12 may be the top plate, if desired.

Referring still to the example shown in FIGS. 1-4, in some examples, a merchandise suspension hook 20 is suspended from an underside of the first plate 12. In some examples, the merchandise suspension hook 20 is generally cylindrical and comprised of a material having the strength to allow merchandise to hang therefrom, including but not limited to stainless steel or other metals. The merchandise suspension hook 20 includes a first portion 22 which is secured to the first plate 12, a second portion 24 downwardly extending from the first portion, and a third portion 26 projecting forwardly of the second portion 24 and adapted to support merchandise having a hole therein or a hole in its packaging. The hole in the merchandise or its packaging is of greater size than the diameter of the third portion 26 of the merchandise suspension hook 20, whereby merchandise may be easily added to or withdrawn from the merchandise suspension hook 20.

In some examples, the first portion 22 of merchandise suspension hook 20 may be permanently secured to the first plate 12 such as by welding, adhesives, or the like. Alternatively, as illustrated, the first portion 22 of the merchandise suspension hook 20 may be releasably secured to the first plate 12, whereby merchandise suspension hooks having differing dimensions for accommodating different types of merchandise may interchangeably connected to the first plate 12. In this regard, an underside of the first plate 12 may have a securing mechanism such as a tube 28 secured thereto. In some examples, the securing mechanism is coupled to the underside of the first plate 12 by welding, adhesives, or the like. The first portion 22 of the merchandise suspension hook 20 may include a threaded end 30 which is inserted into the tube 28 such that at least a portion of the threaded end 30 sticks out from the tube 28. The threaded end 30 is adapted to threadably receive a nut 32 which may be threaded onto the threaded end 30 in order to fasten the merchandise suspension hook 20 to the first plate 12, or which may be unscrewed from the threaded end 30 when it is desired to remove the merchandise suspension hook 20 from the first plate 12. It is also contemplated that the first portion 22 of the merchandise suspension hook 20 may be coupled to the first plate 12 using another method, as desired. Additionally, it is contemplated that the first portion 22 of the merchandise suspension hook 20 may be coupled to an underside of the second plate 14 instead of the first plate 12, without departing from the spirit of the invention.

The second portion 24 of the merchandise suspension hook 20 extends between the first portion 22 of the merchandise suspension hook 20 and the third portion 26 of the merchandise suspension hook 20 and generally has the same diameter as both the first portion 22 and the third portion 26. However, the merchandise suspension hook 20 may include varying diameters, if desired. In the example shown, the second portion 24 extends downward and generally perpendicular from the first portion 22. Moreover, the merchandise suspension hook 20 includes curved transitions between the first portion 22 and the second portion 24 and the second portion 24 and the third portion 26. However, various other configurations have been contemplated.

The third portion 26 of the merchandise suspension hook 20 extends forward from the second portion 24 of the merchandise suspension hook 20 and generally parallel with the first portion 22 of the merchandise suspension hook 20. The third portion 26 of the merchandise suspension hook 20 shown in FIG. 1, includes the same diameter as both the first and second portions 22, 24 of the merchandise suspension hook 20, however, varying diameters have been contemplated. The third portion 26 of the merchandise hook assembly 10 is configured to hold a plurality of merchandise thereon. Additionally, the third portion 26 of the merchandise suspension hook 20 includes a bent portion 42 at its distal end. The bent portion 42 secures the merchandise between the bent portion 42 and the second portion 24 of the merchandise suspension hook 20 and prevents undesirable expulsion of the merchandise from the third portion 26.

Referring to the example shown in FIG. 1, a releasable fastener 38 is configured to pass through the elongated slots 18, 36 to releasably connect the first plate 12 to the second plate 14. Fastener 38, which can be a screw or bolt and a mating nut 32, e.g., wingnut, may or may not include a washer component and permits longitudinal expansion and contraction of the plates relative to one another when the fastener 38 is loosened, whereby the hooks 16, 34 of the first and second plates 12, 14 can expand or contract to accommodate grate 100 bars with wider or narrower spacing. Once the hooks 16, 34 have received their respective grate 100 bars, then the fastener 38 may be tightened to firmly grip the adjustable merchandise hook assembly 10 to the grate 100, whereby merchandise may be hung from the third portion 26 of the merchandise suspension hook 20. In other words, the releasable fastener 38 is configured to releasably couple the first plate 12 and the second plate 14 in at least a first position where a distance between the hook of the first plate 12 and the hook of the second plate 14 is a first distance and in a second position where the distance between the hook of the first plate 12 and the hook of the second plate 14 is a second distance with the second distance being different than the first distance. As such, the releasable fastener 38 is configured to releasably couple the first plate 12 and the second plate 14 in numerous positions which correspond with varying distances between the hook of the first plate 12 and the hook of the second plate 14 and allow for the adjustable merchandise hook assembly 10 to accommodate any span of grate 100 openings.

According to a presently contemplated example, the adjustable merchandise hook assembly 10 is capable of spanning grate 100 openings of 3.25 to 5.5 inches, although the assembly may be easily modified to accommodate grate 100 openings of lesser or greater size as conditions dictate. In some examples, the first bar 102 and the second bar 104 are approximately, 1.25-7.50 inches apart. However, in some examples, the first bar 102 and the second bar 104 are approximately, 2.25-6.50 inches apart. In still other examples, the first bar 102 and the second bar 104 are approximately 3.25-5.50 inches apart. However, various other distances have been contemplated.

In operation, the adjustable merchandise hook assembly 10 includes the fastener 38 secured through the elongated slots 18, 36 of the first plate 12 and the second plate 14, with the first and second plates 12,14 being coupled in the first position. When desired to accommodate a grate 100 having a different sized grate 100 opening, a user will unsecure the nut 32 of the fastener 38 such that the first and second plates 12, 14 are movable with respect to each other. The first and second plates 12, 14 are then moved to a second position which accommodates the different grate 100 opening and then the nut 32 and fastener 38 are once again secured which secures the first and second plates 12, 14 in the second position. Once the fastener 38 has been fastened, merchandise may be hung on the merchandise suspension hook 20 for display.

The merchandise hook assembly 10 as described herein eliminates the need for multiple sizes merchandise hook assemblies to accommodate various sizes of grates.

It will be appreciated by those skilled in the art that changes could be made to the various aspects described above without departing from the broad inventive concept thereof. It is to be understood, therefore, that the subject application is not limited to the particular aspects disclosed, but it is intended to cover modifications within the spirit and scope of the subject application as defined by the appended claims.

I claim:

1. An adjustable merchandise hook assembly configured to be coupled to a substantially horizontal grate having first and second bars disposed parallel to one another, the adjustable merchandise hook assembly comprising:

a first plate including:

a hook for engaging the first bar of the grate, the hook having an open end and a bend end substantially opposite the open end and wherein the bend end extends beyond a plane defined by the first plate, an elongated slot extending parallel to a longitudinal axis of the first plate, and a tube at an underside of the first plate and having a central longitudinal axis parallel to the longitudinal axis of the first plate;

a second plate including:

a hook for engaging the second bar of the grate, the hook having an open end and a bend end substantially opposite the open end and wherein the bend end extends beyond a plane defined by the second plate, and an elongated slot extending parallel to a longitudinal axis of the second plate;

a merchandise suspension hook coupled to the first plate, wherein the merchandise suspension hook includes a first portion, a second portion downwardly extending from the first portion, and a third portion projecting forwardly from the second portion, and wherein the first portion is disposed through the tube and slidable within the tube along its longitudinal extend and rotatable within the tube; and a releasable fastener to releasably couple the first plate and the second plate, wherein the hook of the first plate has a point end about a first side of the plane defined by the first plate and the bend end about a second side opposite the first side of the plane defined by the first plate.

2. The adjustable merchandise hook assembly of claim 1, wherein the elongated slot of the second plate is configured to align with the elongated slot of the first plate.

3. The adjustable merchandise hook assembly of claim 1, wherein the elongated slot of the second plate is configured to overlie the elongated slot of the first plate.

4. The adjustable merchandise hook assembly of claim 1, wherein the merchandise suspension hook is suspended from an underside of the first plate.

5. The adjustable merchandise hook assembly of claim 1, wherein the first portion of the merchandise suspension hook has a threaded end.

6. The adjustable merchandise hook assembly of claim 1, wherein the first distance is approximately 1.25-7.50 inches.

7. The adjustable merchandise hook assembly of claim 1, wherein the first distance is approximately 2.25-6.50 inches.

8. The adjustable merchandise hook assembly of claim 1, wherein at least one of the first or second plates includes a lip extending downwardly along a sidewall thereof.

9. The adjustable merchandise hook assembly of claim 1, wherein the hook of the first plate extends an angle of about 40-80 degrees relative to the plane defined by the first plate.

10. An adjustable merchandise hook assembly comprising:

a first plate including:

a hook for engaging a first bar of a grate, the hook having an open end and a bend end substantially opposite the open end and wherein the bend end extends beyond a plane defined by the first plate, and wherein the hook of the first plate has a point end about a first side of the plane defined by the first plate and the bend end about a second side opposite the first side of the plane defined by the first plate, an elongated slot extending parallel to a longitudinal axis of the first plate, and a tube at an underside of the first plate and having a central longitudinal axis parallel to the longitudinal axis of the first plate;

a second plate including:

a hook for engaging a second bar of the grate, the hook having an open end and a bend end substantially opposite the open end and wherein the bend end extends beyond a plane defined by the second plate, and wherein the hook of the second plate extends an angle of about 40-80 degrees relative to a plane defined by the second plate, and an elongated slot extending parallel to a longitudinal axis of the second plate;

a merchandise suspension hook coupled to the first plate, the merchandise suspension hook including:

a first portion disposed through the tube and slidable within the tube along its longitudinal extend, a second portion downwardly extending from the first portion, and a third portion projecting forwardly from the second portion; and a fastener to releasably couple the first plate and the second plate.

* * * * *